United States Patent [19]

Telfer

[11] 4,030,438

[45] June 21, 1977

[54] SHIPS FOR LIQUID CARGOES

[75] Inventor: Ian Edmund Telfer, Billericay, England

[73] Assignee: The British Petroleum Company Limited, London, England

[22] Filed: June 12, 1975

[21] Appl. No.: 586,360

[30] Foreign Application Priority Data

July 5, 1974 United Kingdom ..... 30017/74

[52] U.S. Cl. ..... 114/74 R; 114/125

[51] Int. Cl.[2] ..... B63B 25/08

[58] Field of Search ..... 114/72, 73, 74 R, 65 R, 114/125

[56] References Cited

UNITED STATES PATENTS

| | | | |
|---|---|---|---|
| 2,710,586 | 6/1955 | Sheldon | 114/74 R |
| 3,326,167 | 6/1967 | Paoli | 114/125 |
| 3,399,645 | 9/1968 | Dahan | 114/74 R |
| 3,785,321 | 1/1974 | Backstrom | 14/74 R |

FOREIGN PATENTS OR APPLICATIONS

| | | | |
|---|---|---|---|
| 1,225,002 | 6/1960 | France | 114/74 R |

*Primary Examiner*—Trygve M. Blix
*Assistant Examiner*—Sherman D. Basinger
*Attorney, Agent, or Firm*—Morgan, Finnegan, Pine, Foley & Lee

[57] ABSTRACT

A ship for liquid cargoes, e.g. an oil tanker, has two longitudinal bulkheads giving central and wing areas and transverse bulkheads dividing the areas into tanks. The wing areas have upper cargo tanks and lower ballast tanks, but the latter have vertical portions extending to deck level giving for example an L-shaped configuration.

11 Claims, 2 Drawing Figures

SHIPS FOR LIQUID CARGOES

Figure 1:
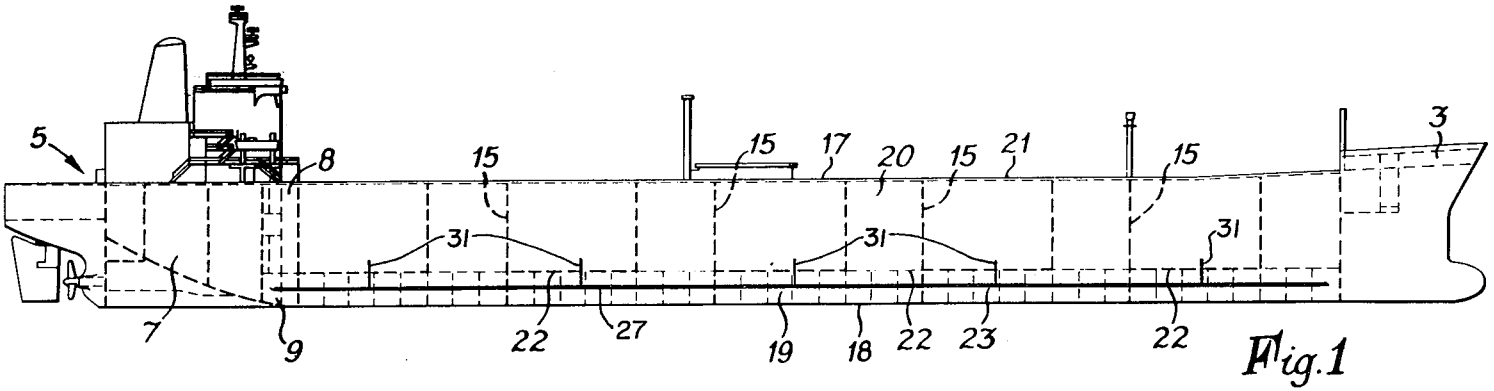

This invention relates to ships for carrying liquid cargoes, particularly tankers for carrying petroleum crude oil or products, hereinafter referred to as oil tankers.

Oil tanker operations normally involve laternate voyages with cargo and in ballast, i.e. with the tank space partially filled with sea water. Until recently the ballast water has been placed in the oil tanks, but in order to reduce the risk of pollution when the oily ballast water is discharged, tankers with separate oil and ballast tanks have been proposed. One such design is shown in U.K. Pat. No. 981017 with central oil tanks and wing ballast tanks separated by longitudinal bulkheads. In other designs, it has been proposed to carry ballast in double bottoms.

An improved form of construction is now proposed with both oil and ballast wing tanks positioned in a particular way.

According to the present invention a ship for carrying liquid cargoes having at least two longitudinal bulkheads separating a central tank area from wing tank areas and transverse bulkheads dividing the central and wing tank areas into a number of tanks, is characterised in that the wing tank areas contain two sets of tanks, one lower set, suitable for holding ballast, extending beneath the other upper set, suitable for holding cargo, but with the tanks of the lower set having vertical, portions extending to deck level.

Preferably the wing ballast tanks are L-shaped with the horizontal portion of the L extending longitudinally along the ship. The horizontal portion of the L may, however, extend laterally across the ship. The cargo tanks then occupy the space above and to the side of the L and also extend to deck level. In other embodiments the ballast tanks may have two vertical portions forming a ⊔ -shaped with the cargo tanks within the space defined by the ⊔ , or the ballast tanks may have both longitudinal and lateral horiozontal portions i.e. shaped like two L's at right angles.

Preferably there is one ballast and one cargo tank in each wing section defined by two transverse bulkheads, a longitudinal bulkhead and the side of the ship. The longitudinal positioning of a cargo tank within a wing section can be varied as necessary during the design stage to control the longitudinal center of gravity and thus buoyancy in load and ballast conditions.

By having sets of wing tanks above each other it is possible to have a horizontal flat extending along the length of the wing tank areas between the upper and lower set of tanks. Where the cargo tanks are above the horizontal portions of the ballast tanks the flat is solid; where the flat has to pass through the vertical portions of the lower set of ballast tanks it should be perforated so that the horizontal and vertical portions of the ballast tanks are in communication with each other. The flat provides longitudinal strengthening for the ship in an area particularly vulnerable to damage by collision. The bulbous bows which are a common feature of large carrier vessels are particularly liable to damage this area of a ship by ramming. The flat is in effect, equivalent to a double bottom for the ship within the wing tank areas. Since the tanks of the lower set are designed to hold ballast and not cargo, they will be empty when the ship is loaded and the risk of pollution as a result of damage to the ship by collision or grounding is thus reduced. However, in the present design, since the ballast tanks extend up to deck level, there are no ventilation or access problems normally assocated with double bottoms.

The ballast tanks are positioned in the bilge area, which is an area where structural stengthening is particularly needed. In addition to the strengthening provided by the flat described above other structural members to stiffen the hull may be positioned in the horizontal portions of ballast tanks e.g. lateral stiffeners. In the vertical portions of the ballast tanks structural members can be used to strength the transverse and longitudinal bulkheads. The cargo tanks can thus be kept relatively free of cross member, buttresses etc. and have a minimum surface area on which sediments can accumulate. This, in turn, reduces the amount of cargo tank washing required. In particular the wing cargo tanks do not extend dhown into the bilge area and can have flat bottoms formed by the horizontal flat.

In the central area the risk of damage is less than in the wing areas and the problems of sedimentation and tank cleaning are less acute so that the central cargo tanks may extend to the bottom of the ship in the conventional manner.

Piping for emptying and filling the ballast tanks can extend along and within the horizontal portions of the ballast tanks to the main pumping machinery, so that no ballast pipes need pass through cargo tanks. The main piping for emptying and filling the cargo tank can extend along and within the central cargo tank area so that no cargo pipes need pass through ballast tanks. The wing cargo tanks can be connected to the central cargo tanks through the longitudinal bulkheads and since they are relatively high up on the ship's structure they can discharge into the central tanks under gravity. Pumps however, can be used if desired for transferring oil to and from the central and wing cargo tanks.

The relative amounts of cargo and ballast tank capacity by volume may vary somewhat depending on the likely use of the ship but the ballast capacity will normally be from 15 to 40% of the total cargo capacity. By suitable choice of tank dimensions and proportions of balast tank to wing cargo tank all of this ballast capacity can be accommodated within the wing tank area. The ballast capacity in the wing areas may be from 50 to 200% of the cargo capacity in the wing areas. The vertical portions of the ballast tanks, measured from the top of the horizontal portions, preferably provide from 30 to 70% of the total ballast capacity. The width of each of the wing tank areas should preferably not be less than one-fifth of the beam of the ship but need not exceed 11.5 meters in accordance with established damage criteria. Similarly the length of the vertical portion sof the ballast tanks areas is from damage consideration, preferably not less than 1/3 1⅓ where 1 is the length of the ship between perpendicular. It need not, however, exceed 14.5 metres. Further adjustment of ballast volume may be obtained by varying the position of the horizontal flat. This is preferably positioned at from 15 to 45% of the total height of the tanker from keel to deck, but is desirably not less than 4 meters to allow for reasonable access and ventilation. The upper limit for height will depend on stability considerations. The design criteria referred to herein are in accord with the recommendations expressed in the International Convention for the Prevention of Pollution from Ships 1973, specifically Annex 1, Regulations 13, 22, 23, 24 and 25.

Figure 2:
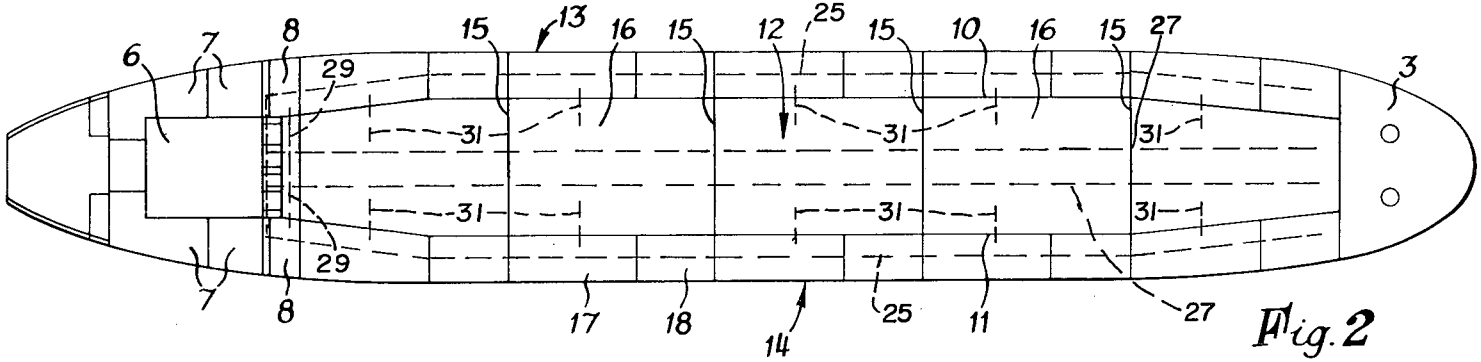

The invention is illustrated with reference to the accompanying drawings in which:

FIG. 1 is a section through an oil tanker according to the present invention; and FIG. 2 is a plan view of an oil tanker according to the present invention.

In the drawings a tanker has a conventional fore peak section 3 and an after section 5 housing, inter alia, the propulsion machinery in space 6, fuel oil tanks 7, slop tank 8 and pump room 9. The main cargo space amidships is divided by two longitudinal bulkheads 10, 11 into a central oil tank area 12 and wing tank area 13 and 14. Transverse bulkheads 15 divide both the central and wing areas into sections. In the central areas each section contains one oil tank 16 but in the wing areas there are two tanks 17 and 18 in each section. Tanks 17 are oil tanks and tanks 18 are ballast tanks, with horizontal portion 19 in the bilge area and a vertical portion 20 extending up to the level of the deck 21. A horizontal flat 22 extends along the wing cargo sections separating the oil tanks 17 from the horizontal portions 19 of the ballast tanks and extending through the vertical portions 20 of the ballast tanks. The flat is solid where it separates the tanks and perforated where it passes through the vertical portions 20 of the ballast tank. Structural member 23 in the horizontal portions 19 of the ballast tank provide stengthening fcr the hull. Members (not shown) are also located in the vertical portions 20 of the ballast tanks to strengthen the transverse bulkheads 15.

Ballast pipes 25 extend along and within the horizontal portions 19 of the ballast tanks to the pump room 9, passing through the transverse bulkheads 15. Similarly cargo pipes 27 extend along and within the central oil tanks 16 to pump room 9, with connections 27 to slop tank 8 for use during tank washing. Each wing oil tank 17 has a pipe 31 near its base passing through the adjacent longitudinal bulkheads 10 or 11, so that oil can pass under gravity from the wing tanks to the adjacent central tanks during discharge and vice versa during loading. The pipes may have an associated pump for use if required.

In a specific design according to the drawings the ballast tank capacity was 27% of the total oil tak capacity. In the wing areas the ballast tank capacity was 116% of the oil tank capacity. The height of the horizontal portions 19 of the ballast tanks was 27% of the height of the ship from keel to deck and the length of the vertical portions 20 of the ballast tanks was 37% of the total lengths between transverse bulkheads which corresponding to 0.52 1 . The vertical portions 20 of the ballast tanks, measured from the top of the horizontal portions 21, provided 54% of the ballast capacity. Each wing area had a width of 20% of the beam of the ship.

I claim:

1. In a ship for carrying liquid cargoes having at least two longitudinal bulkheads separating a central tank area from wing tank areas and transverse bulkheads dividing the central and wing tank areas into a number of tanks, the improvement comprising two sets of tanks in each of the wing tank areas, one lower set, suitable for holding ballast, extending beneath the other upper set, suitable for holding cargo, but with the tanks of the lower set having vertical portions extending to deck level and a horizontal flat extending along the length of the wing tank areas between the upper and lower sets of tanks, the flat being solid between the sets of tanks and perforated where it passes through the vertical portions of the lower set of tanks.

2. A ship as claimed in claim 1 wherein the ballast capacity is from 15 to 40% by volume of the total cargo capacity.

3. A ship as claimed in claim 2 wherein the ballast capacity is from 50 to 200% of the cargo capacity in the wing areas.

4. A ship as claimed in claim 2 wherein the vertical portions of the ballast tanks have from 33 to 70% of the total ballast tank capacity.

5. A ship as claimed in claim 2 wherein the length of the vertical portions of the ballast tanks are not less than ⅓ 1 , where 1 is the length of the ship between perpendiculars, but not more than 14.5 meters.

6. A ship as claimed in claim 2 wherein the height of the horizontal portions of the ballast tanks is from 15 to 45% of the total height of the tanker from keel to deck, but is at least 4 meters.

7. A ship as claimed in claim 2 wherein the width of each wing area is not less than 1/5 of the beam of the ship, but not more than 11.5 meters.

8. A ship for carrying liquid cargoes having at least two longitudinal bulkheads separating a central tank area from wing tank areas and transverse bulkheads dividing the central and wing tank areas into a number of tanks, characterized in that the wing tank areas contain two sets of tanks, one lower set, suitable for holding ballast, extending beneath the other upper set, suitable for holding cargo, but with the tanks of the lower set having L-shaped configurations, with the horizontal portion of the L extending longitudinal and the vertical portion extending to the deck level, said wing tank areas further having a horizontal flat extending along the length of said tank areas between the upper end lower sets of tanks, said flat being solid between the sets of tanks and perforated where it passes through the vertical portions of the lower set of tanks.

9. A ship as claimed in claim 8 wherein the wing ballast tanks have structural stiffening members in their horizontal and vertical portions.

10. A ship as claimed in claim 9 wherein piping for emptying and filling the ballast tanks extends along and within the horizontal portions of the tanks.

11. A ship as claimed in claim 10 wherein piping for emptying and filling the cargo tanks extends along and within the central tank area with connections through the longitudinal bulkheads between the wing cargo tanks and the central tanks.

* * * * *

UNITED STATES PATENT AND TRADEMARK OFFICE

CERTIFICATE OF CORRECTION

PATENT NO. : 4,030,438

DATED : June 21, 1977

INVENTOR(S) : Ian Edmund Telfer

It is certified that error appears in the above-identified patent and that said Letters Patent are hereby corrected as shown below:

Claim 5, Column 4, line 23, "1/3 1" should be --1/3 1 2/3 --;

Claim 8, Column 4, line 44, "end" should be --and--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*